US005816306A

United States Patent [19]

Giacomel

[11] Patent Number: 5,816,306

[45] **Date of Patent: *Oct. 6, 1998**

[54] SHAPE MEMORY ALLOY ACTUATOR

[76] Inventor: Jeffrey A. Giacomel, P.O. Box 201444, Arlington, Tex. 76006-1444

[ * ] Notice: The term of this patent shall not extend beyond the expiration date of Pat. No. 5,275,217.

[21] Appl. No.: 648,144

[22] PCT Filed: Nov. 22, 1993

[86] PCT No.: PCT/US93/11368

§ 371 Date: Jul. 15, 1996

§ 102(e) Date: Jul. 15, 1996

[87] PCT Pub. No.: WO95/14843

PCT Pub. Date: Jun. 1, 1995

[51] Int. Cl.[6] ..... E05F 15/20

[52] U.S. Cl. ..... 160/6; 160/176.1 P

[58] Field of Search ..... 160/6, 7, 1, 5, 160/168.1 R, 168.1 V, 168.1 P, 176.1 R, 176.1 V, 176.1 P, 177 R, 177 V, 900, DIG. 17; 49/82.1; 454/224, 258

[56] References Cited

U.S. PATENT DOCUMENTS

| | | | |
|---|---|---|---|
| 3,177,367 | 4/1965 | Brown | 250/203 R |
| 3,204,690 | 9/1965 | Nyc | 160/176.1 P |
| 3,436,016 | 4/1969 | Edwards | 236/49 |
| 3,646,985 | 3/1972 | Klann | 160/168.1 P |
| 3,860,055 | 1/1975 | Wild | 160/1 |
| 4,497,241 | 2/1985 | Ohtaka | 98/40.25 |
| 4,567,549 | 1/1986 | Lemme | 362/279 |
| 4,773,733 | 9/1988 | Murphy et al. | 160/5 X |
| 5,063,984 | 11/1991 | Cherveny | 160/1 X |
| 5,107,916 | 4/1992 | Roermund et al. | 160/6 |
| 5,142,133 | 8/1992 | Kern et al. | 160/5 X |
| 5,275,219 | 1/1994 | Giacomel | 160/6 |

*Primary Examiner*—David M. Purol
*Attorney, Agent, or Firm*—W. Thomas Timmons; Timmons & Kelly

[57] ABSTRACT

A shape memory alloy actuator is disclosed. In one arrangement, a louvered window covering, such as a vertical or horizontal venetian blind, is provided with a thermal actuator to automatically rotate slats forming the louvered window covering between open and closed positions. The actuator includes at least one shape memory alloy spring that, when heated above a predetermined temperature, extends to engage and move a rack that drives a pinion gear. The pinion gear rotates, through a coupling mechanism, a rod extending the length of the blind. A second shape memory alloy spring may be installed to rotate the rod in the opposite direction. The rod intercouples the slats in a manner such that the rotation of the rod rotates the slats in unison between closed and open positions. The shape memory alloy spring may be heated with a current supplied by a controller in response to a predetermined environmental condition. The venetian blind mechanism's manual actuation would not be compromised or interfered with by the thermal actuator of the use of the thermal actuator because the thermal actuator is not physically coupled to the blind except intermittently.

49 Claims, 5 Drawing Sheets

FIG. 2
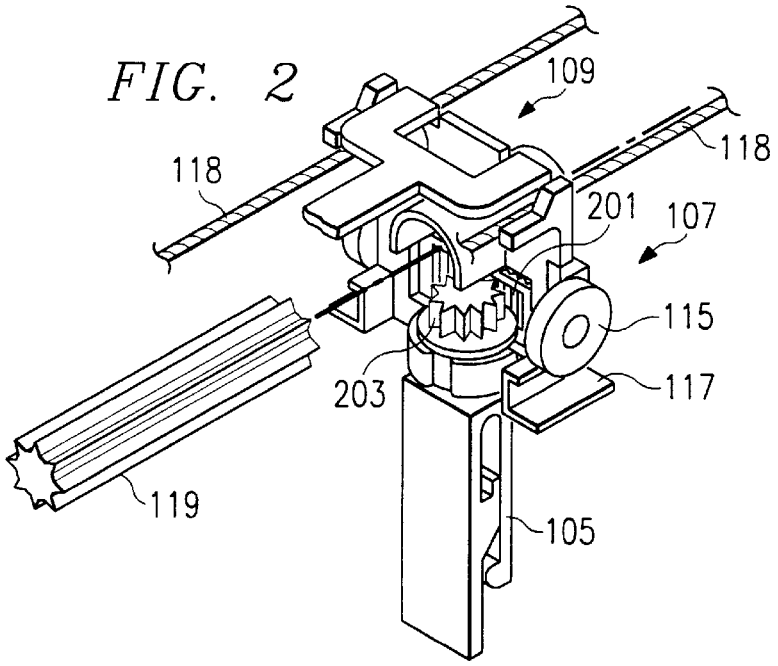
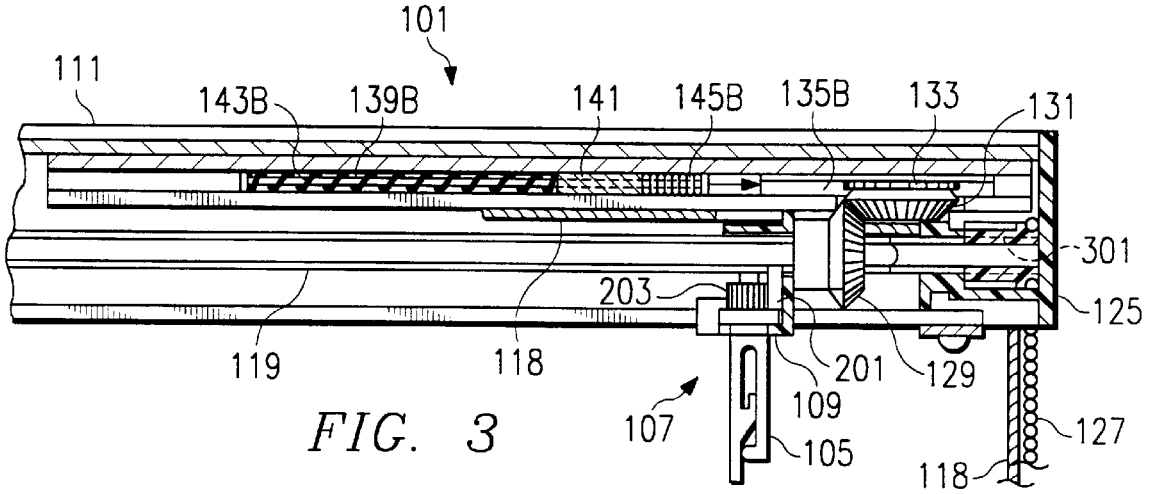
FIG. 3

SHAPE MEMORY ALLOY ACTUATOR

BACKGROUND OF THE INVENTION

1. Field of the Invention

The invention relates generally to louvered coverings and more particularly to systems for automatically opening and closing window blinds.

2. Description of Related Art

Although this invention is applicable to the actuating of various mechanisms such as metal and wood storm windows, and heating, ventilation and air conditioning duct work for centralized systems, it has been found to be particularly useful in the environment of louvered window coverings. Therefore, without limiting the applicability of the invention to "actuating louvered window coverings", the invention will be described in such environment.

Louvered window coverings, such as venetian blinds, vertical blinds, shutters and other types of movable shades (generally referred to as "blinds"), are generally thought of as primarily providing privacy. However, significant heat is generated in enclosures by incident sunlight coming through windows. Because they regulate the amount of incident light within an enclosure, blinds thus play an important role in controlling the ambient temperature in the enclosure, and in conservation and efficient utilization of energy.

Most people prefer that the interior temperature of their homes remain at approximately 72 degrees Fahrenheit for optimal comfort. During the summer, for example, blinds may be closed to reduce heat and to save energy required for air conditioning to cool the air heated by light coming through the windows. During the winter, to take advantage of the heat generated by the light, blinds may be opened during the day and closed at night to slow the loss of heat through the windows, thereby saving energy. As a significant amount of energy is consumed in heating and cooling enclosures, proper operation of blinds during the course of the seasons can materially contribute to energy conservation by its efficient utilization.

Blinds enhance security as well. When used on business premises, for example, blinds should be left open at night so that security personnel can peer through the windows. At home, however, the blinds should be closed.

Commercially available louvered window coverings are, with few exceptions, manually operated. Designers and manufacturers know that successful blinds and shades should be of simple design for low cost, reliable operation and convenience of use, and simple designs are manually operated. To take full advantage of the benefits of movable or adjustable louvered window coverings, therefore, requires a vigilant person to operate the blinds, one who understands these benefits. As such circumstances are rare, so too are blinds rarely used to their fullest benefit and advantage. Blinds which automatically open and close are therefore desirable.

Despite the needs and desires for automatic systems, the industry still strongly favors the simple design of manual blinds. There have been attempts to automate operation of blinds, primarily for convenience of remote operation, though also to respond to changes in the environment, particularly the amount of light incident on the blinds. Previous attempts at automation have generally been, however, too costly and failed in terms of cost, reliability and adaptability to the wide variety of blind mechanisms.

The automation of blinds in the prior art has involved coupling the blind's positioning mechanism, typically a rod running the length of the blind that intercouples the slats of the blind for rotation in unison, to direct current (DC) motors or solenoids that generate the work necessary for opening and closing the blinds. They are also very noisy, making them less appealing. The motors hum, the solenoid actuator clicks, and the gears grind. Furthermore, DC motors and solenoids are relatively large and cumbersome. They often are not adaptable to some types of blind mechanisms. They also sometimes cannot be incorporated into the blind mechanism, but must be mounted either on a wall to pull a draw string, or to the outside of the housing for the blind mechanism. The latter case requires quite complex mechanical interfaces with the blind mechanisms, necessitating substantial and numerous types of modifications to the various types of preexisting blinds for retrofit, or special manufacture of blinds with the motors. Either way, simplicity is sacrificed and cost substantially increased.

The fact that DC motors and solenoids require a source of power for operation further increases cost and complexity. Each blind must be equipped with an AC to DC converter if power is taken from a wall socket. Otherwise, batteries must be used. Typically, they are expensive varieties, such as NiCad batteries, so that they do not have to be frequently replaced and may be recharged by expensive solar, photoelectric cells or circuitry to provide a constant trickle charge of current.

Moreover, to control the DC motors and solenoids during operation of the blind mechanism, relatively complex and expensive circuits must be used. These circuits are further complicated where the same circuit centrally controls several different types of blind mechanisms, as each mechanism potentially requires specialized operation of the DC motor or solenoids.

SUMMARY OF THE INVENTION

The invention recognizes these and other shortcomings of previous automatic blinds and overcomes them by employing a compact, actuator module easily fitted to standard commercial blinds, to create an automated system that is fully responsive to the environment without human intervention and materially contributes to conservation and efficient utilization of energy.

The actuator module includes a thermal actuator which comprises a spring formed from a shape memory alloy (sma) that is coupled to a standard blind mechanism by a mechanical interface. The shape memory alloy (sma) has a first, relaxed (martensite) state or phase at ambient temperature and a second, fully-actuated (austenite) state or phase when heated to a predetermined temperature. When shaped into a spring, the transition of the shape memory alloy (sma) from the relaxed state to the fully-actuated state causes linear motion along the axis of the spring that is applied to the mechanical interface coupling the spring to the blind mechanism that in turn actually rotates the slats of the blinds.

Because of its narrow profile and linear orientation, the actuator module is easily fitted within housings, called rails sometimes, of standard blind positioning mechanisms or obscured along the backside of a rail. Thus, current blind designs may be continued to be used, with little added complexity or cost of manufacture, and pre-existing blinds easily retrofitted.

As the shape memory alloy (sma) spring has a predetermined stroke, no control circuits are required to position the blinds. The spring and mechanical interface against which it acts are chosen to provide full linear movement of the spring to rotate the slats between open and closed positions.

Energy for the work of rotating the slats is supplied by a current which varies in response to external input. The current is run through the sma spring, which is highly resistive, thereby producing heat to warm the sma spring to the predetermined temperature. The shape memory alloy (sma) spring is chosen such that, when the ambient temperature is below a predetermined temperature it is in the relaxed, martensite state and the blinds are in an open position. When the ambient temperature reaches a preselected temperature, a sensor set to the preselected temperature passes a current through the sma spring and the sma spring extends by changing phases from its relaxed martensitic state to its actuated austenitic state, causing the slats of the blinds to rotate to a closed position. When the current ceases to be passed through the sma spring, the temperature of the sma spring falls back below a second predetermined temperature (the temperature response of the shape memory alloy has a hysteresis) and the sma spring relaxes. A biasing spring operatively positioned in the actuator module causes the sma spring to be retracted to a compressed position. The slats remain in the set position as the sma spring is retracted because the sma spring is not permanently coupled or attached to the blind.

The current may be supplied from an independent source, such as a solar cell. When the current from the solar cell exceeds a predetermined point in response to a certain amount or intensity of sunlight, the sma spring is actuated to rotate the slats of the blinds to either the open or closed position as required. Also, the solar energy could be stored in rechargeable batteries for a stand-alone system. Otherwise, the trickle current is supplied from a controller which is electrically connected to the sma spring. The controller may run current in the sma spring in response to light, temperature sensors, timers, or to manually operated remote controls. In this instance, the sma spring is physically coupled to the blind.

In accordance with another aspect of the invention, a second sma spring may be added to respond to ambient temperature or be heated with a current, so as to rotate the slats in a direction opposite to that caused by the first sma spring. When added to the passive electronic configuration, for example, a complementary second sma spring having a higher temperature range (which is a function of the alloy content) permits opening and closing of the blinds at different temperature ranges. As another example, when the first sma spring is controlled by a solar cell that opens the blinds in summer to let in sunshine, the complementary sma spring may close the blinds when the ambient temperature reaches a predetermined temperature. Magnifying or fresnel lens may be employed to concentrate the sun or heat as opposed to electronics.

For fully versatile control, a pair of complementary sma springs are used with a controller supplying current to heat the sma springs. One sma spring rotating the slats to an open position and the other rotating them to a closed position. The controller is programmed to balance the needs of the room for light, energy efficiency and security for any given time of day and day of the year, all without intervention of a person. The controller electronics may be mounted within the blind or externally.

Several other advantages are derived from the use of sma springs as blind actuators. First, because they may be incorporated into a wide variety of blind mechanisms without substantial modification, blinds of different types throughout an entire building can be controlled from a central location without an increase in the complexity of the control. Each blind, no matter what type, is operated with the same control signal. Furthermore, sma springs are capable of fine control, if desired, because of their predictable temperature versus displacement curve. By correlating power input to the sma spring with the displacement of the sma spring, the slats may be finely positioned by controlling the current flowing through the sma spring to partially actuate the sma spring and partially moving the slats. This can be accomplished by controlling the power input vs the heat transfer rate through a mathematical algorithm unique to the device characteristics. This requires, however, a microprocessor driven controller. Adding a feedback loop comprised of a simple variable resistor dependent on the position of the blind mechanism is a simple means of accomplishing the fine control. Moreover, the same fine positioning may be achieved without significantly increasing the complexity of the actuator in the blind mechanism.

The second sma spring also removes the need to constantly trickle current through the first sma spring to maintain it in an actuated austenitic state, thereby removing unnecessary stress and preserving their life. It permits free, manual movement of the blind mechanism throughout its complete range of movement without interfering or disrupting the blind's automation. Moreover, this approach eliminates the need to use constantly attached springs that are unreliable due to the fact that they degenerate with use.

In accordance with other aspects of the invention, a rack and pinion gear serves as a mechanical interface between the sma spring and the blind mechanism's drive shaft, the sma spring controlling the position of the rack.

These and other aspects and advantages of the invention are shown in the following description of its preferred embodiment illustrated in the accompanying drawings.

BRIEF DESCRIPTION OF THE DRAWING

FIG. 2 is a detail perspective view of a blind rotating mechanism used in the blind positioning mechanism of FIG. 1;

FIG. 3 is a cross-section of FIG. 1, taken along section line 3—3;

DESCRIPTION OF THE PREFERRED EMBODIMENT

Figure 1:
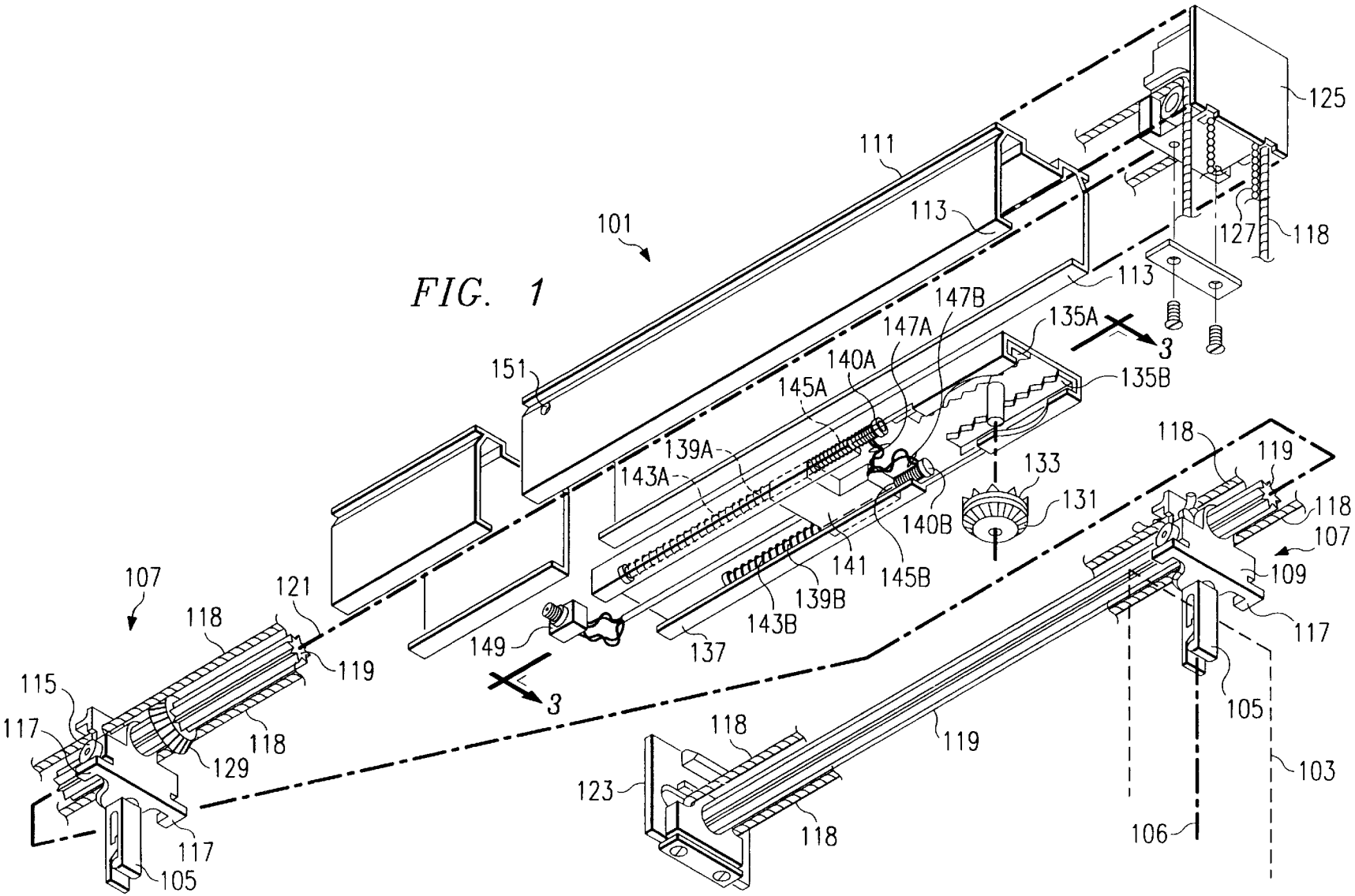
FIG. 1 is an exploded perspective view of a standard commercially available blind positioning mechanism, intended to be representative of blind mechanisms generally, fitted with an actuator module in accordance with the present invention.

Referring to FIG. 1, blind mechanism 101 is representative of standard, commercially available mechanisms for operating a vertical blind or louver with movable slats or fins. Each vertical slat 103 is hung from a clip 105. Clip 105 is, in turn, coupled for rotation about a vertical axis 106 running down through the middle of the slat to slat positioning mechanism 107. This permits rotation of the slats of the blind 180 degrees, between a closed position (0 and 180 degrees) and an open position (90 degrees). Each slat positioning mechanism 107 includes a support member 109 that slides translationally along the longitudinal length of enclosure 111, across an opening or window (not shown). Support member 109 includes wheels 115, each mounted on the side of support member 109, that roll along flange sections 113 of enclosure 111. To properly fix the orientation of support member 109 so that it freely moves within enclosure 111, the support member also includes two wing sections 117, one on each side, disposed on the bottom side of flange 113, opposite of the side engaged by wheels 115. Support member 109 is also sized to closely fit a cross-sectional profile of enclosure 111 and thereby further stabilize its orientation. Cord 118 is used to pull the slat positioning mechanisms 107 longitudinally across the window.

Referring now to FIGS. 1 and 3 together, to transmit motion to slats 103 and to synchronize their rotation, pinion shaft 119 extends horizontally along the length of the enclosure 111, across the window or opening, and is mounted within the enclosure for rotation about axis 121. One end of the pinion shaft 119 fits within a support cylinder defined within a plastic end cap 123. The other end of the pinion shaft 119 is fitted within a sprocket-like coupling 301 (FIG. 3) rotatably fixed within cap 125 for coupling chain 127 to the shaft. Preferably, the gear ratio of the sprocket to the pinion shaft is one to one. However, the use of various gear ratios, idler gears and other gearing schemes may also be used.

Referring now to FIGS. 2 and 3 for explanation of the interaction of pinion shaft 119 and slat positioning mechanisms 107, teeth on the pinion shaft 119 mesh with a top row of teeth on rack 201 that is mounted on support member 109 for movement transverse to the shaft. A second set of teeth on rack 201 engages pinion gear 203. Pinion gear 203 is connected to clip 105, the rotational axis of pinion gear 203 coinciding with the rotational axis 106 (FIG. 1) of the clip. Pulling chain 127 causes pinion shaft 119 to rotate, which in turn moves rack 201, and movement of rack 201 rotates pinion gear 203, which in turn rotates clip 105 and slat 103 (FIG. 1).

With reference to FIG. 1, actuator module 130 comprises rack carrier or housing 137 with racks 135A and 135B mounted for sliding movement therein. Pinion gear 133 together with bevel gear 131 are mounted for rotational movement with pinion gear 133 positioned to engage racks 135A and 135B. Non-conducting support block 141 provides support for linear movement of parallel rods 139A and 139B which are positioned such that heads 140A and 140B, respectively, may be placed in contact with racks 135A and 135B, respectively. Biasing springs 143A and 143B are positioned around rods 139A and 139B, respectively, on one side of support block 141. Shape memory alloy (sma) springs 145A and 145B are positioned around rods 139A and 139B, respectively, on the opposite side of support block 141. Conductor wire pairs 147A and 147B provide current to the sma springs 145A and 145B through socket 149.

Referring back to FIGS. 1 and 3, automatic operation of the positions of the slats is achieved by fitting pinion shaft 119 with bevel gear 129, the position of which is secured with a set screw. When blind mechanism 101 is fully assembled, as shown in FIG. 3, bevel gear 129 meshes with bevel gear 131, which in turn is connected to pinion gear 133. Pinion gear 133 engages racks 135A and 135B, the racks being disposed on opposite sides of pinion gear 133. The racks 135A and 135B slide along housing or rack carrier 137, which is an injection molded plastic having a low coefficient of friction. Pushing on one rack rotates slats in one direction, and pushing on the other rack rotates the slats in the opposite direction.

Each rack is pushed by one of two parallel rods 139A and 139B. Each rod moves translationally through a hole in a non-conducting support block 141. Placed between a head at one end of each rod and the support block 141 are biasing springs 143A and 143B that encircle rods 139A and 139B, respectively, The biasing springs are compressed so as to generate a force to keep the rods in a retracted position as shown.

On the other side of support block 141 are sma springs 145A and 145B that work to extend the rods 139A and 139B. The sma springs 145A and 145B are shaped from a shape memory alloy that includes nickel and titanium, known as "Nitinol" or "Tinel", depending upon other alloy constituents. Their spring rates are determined by the shear modulus of the material, which, in turn, changes with the temperature as a result of a reversible martensite to austenite solid state phase transformation. The spring rate is comparatively low when "cold" and high when "warm". When cold, the rate of the sma springs is too small to overcome the opposing force applied to the rods by the biasing springs. However, when warmed, the sma spring rates increase, overcoming the biasing forces to extend the rods. The maximum length to which the sma springs extend is termed the shape set length.

Each rod 139A and 139B linearly displaces one of the two racks 135A and 135B when extended. Displacement of one of the racks rotates pinion gear 133 in one direction, and displacement of the other rack rotates the pinion gear 133 in the opposite direction. Rotation of the pinion gear 133 rotates bevel gear 131. Rod 139A is longer than rod 139B and has a stroke that is twice the length of the stroke of rod 139B. To fully extend rod 139A, sma spring 145A has twice the shape set length as sma spring 145B. The longer stroke of rod 139A ensures that, no matter what position the slats of the blind are in, they are rotated to a closed position when rod 139A is fully extended. The stroke of rod 139B is determined so that, when fully extended, the slats are turned 90 degrees to the fully opened position.

When the temperature falls, the sma springs relax and are compressed by the rods with biasing forces applied by bias springs 143A and 143B. Heads 140A and 140B of rods 139A and 139B are offset or separated from the racks 135A and 135B when the sma springs are fully relaxed and the rods are fully retracted by biasing springs 143A and 143B. The distance by which the rods are offset or separated is at least equal to the full travel distance of the racks in each of the slats closed positions. With this offset or separation, the slats may be manually rotated without interference from the rods trying to position the racks. To accommodate sma spring 145A, having the longer shape set length, support block 141 is formed in an "L" shape. A square block, however, could be used but the racks would have to be made with uneven lengths.

The actual temperatures at which the sma springs 145A and 145B transition can be chosen over a wide range of temperatures. However, each alloy displays a temperature hysteresis effect between its austenite and martensite states. In the martensite state, the sma spring remains relaxed below the martensite state start temperature. The sma spring linearly extends, while constantly weighted, as its temperature rises above the martensite start temperature, until it reaches the martensite finish temperature. The transition in the austenite state is, however, displaced to a greater temperature. The temperature at which the sma springs begin to relax in the austenite state is greater than the martensite finish temperature; and the austenite finish temperature, the temperature at which the sma spring is relaxed, is greater than the martensite start temperature. The hysteresis depends on the type of shape memory alloy used. Two types of shape memory alloys are preferred. One is Alloy 49-51 "Tinel"; the other is a very new alloy, generically referred to as "R-phased transition alloy". Alloy 49-51 has a hysteresis of approximately 15 degrees centigrade. R-phased Transition Alloy has a tight hysteresis of approximately 2 degrees centigrade. The hysteresis prevents rotation of the blinds when the temperatures of the springs are within the transition region.

To heat the sma springs 145A and 145B, ambient temperature may be relied on, or an electrical voltage may be applied across each sma spring, causing it to conduct current. Conductor wire pairs 147A and 147B, one wire in a pair being connected to each end of the sma spring, provide the current from a controller (not shown) that is plugged into socket 149 extending through hole 151 in enclosure 111. Due to the relatively high resistivity of the shape memory alloy, the sma springs heat rather rapidly. The sma springs are coated with an insulating plastic to provide electrical resistance. Furthermore, to facilitate attaching the wires to the sma springs, the ends of sma springs are shaped into a straight length. Otherwise, connection to a curvilinear section could cause the connection to loosen.

The sma springs are easily adaptable to work with a wide variety of blind mechanisms. Most blinds include some sort of rotating member, or drive shaft, that runs the length of the blind to simultaneously rotate the blind slats. Examples of these include, without limitation: a vertical blind mechanism that uses a rod to rotate a worm gear that, in turn, drives a rack to pivot the vertical slats; or horizontal blind mechanisms that use a rod in cooperation with a string mechanism to rotate the slats. A rack and pinion mechanical interface, similar to that described, may be used to couple the memory alloy springs to the rotating rod. However, it is possible that a blind mechanism that utilizes a translationally moving member instead of a rod to intercouple the blind may be used to drive the pivoting of the slats of the blind in unison. In this case, the linear movement of the sma springs may be coupled to the blind mechanism without use of any rotating members, using for example just a rack or some other linearly moving interface.

Furthermore, to accommodate different blinds, sma springs may be coupled in parallel or in series to increase force and/or stroke as required. Also, the helical sma springs may be stretched, instead of compressed, in the martensitic phase so that the sma spring contracts instead of extends when heat is applied.

Moreover, the sma springs need not necessarily be helical. Dual opposing, torsion sma springs about the blind's drive shaft may also be used. A length of wire formed from a shape memory alloy material can also function as a spring. For example, a shape memory alloy wire that is placed about two pulleys of different diameters acts as a sma spring when the smaller pulley is a heat source and the larger pulley is a heat sink. Applying heat to the smaller pulley causes the wire to rotate the pulleys, thereby creating work which can be used to rotate the blinds.

Figure 4:
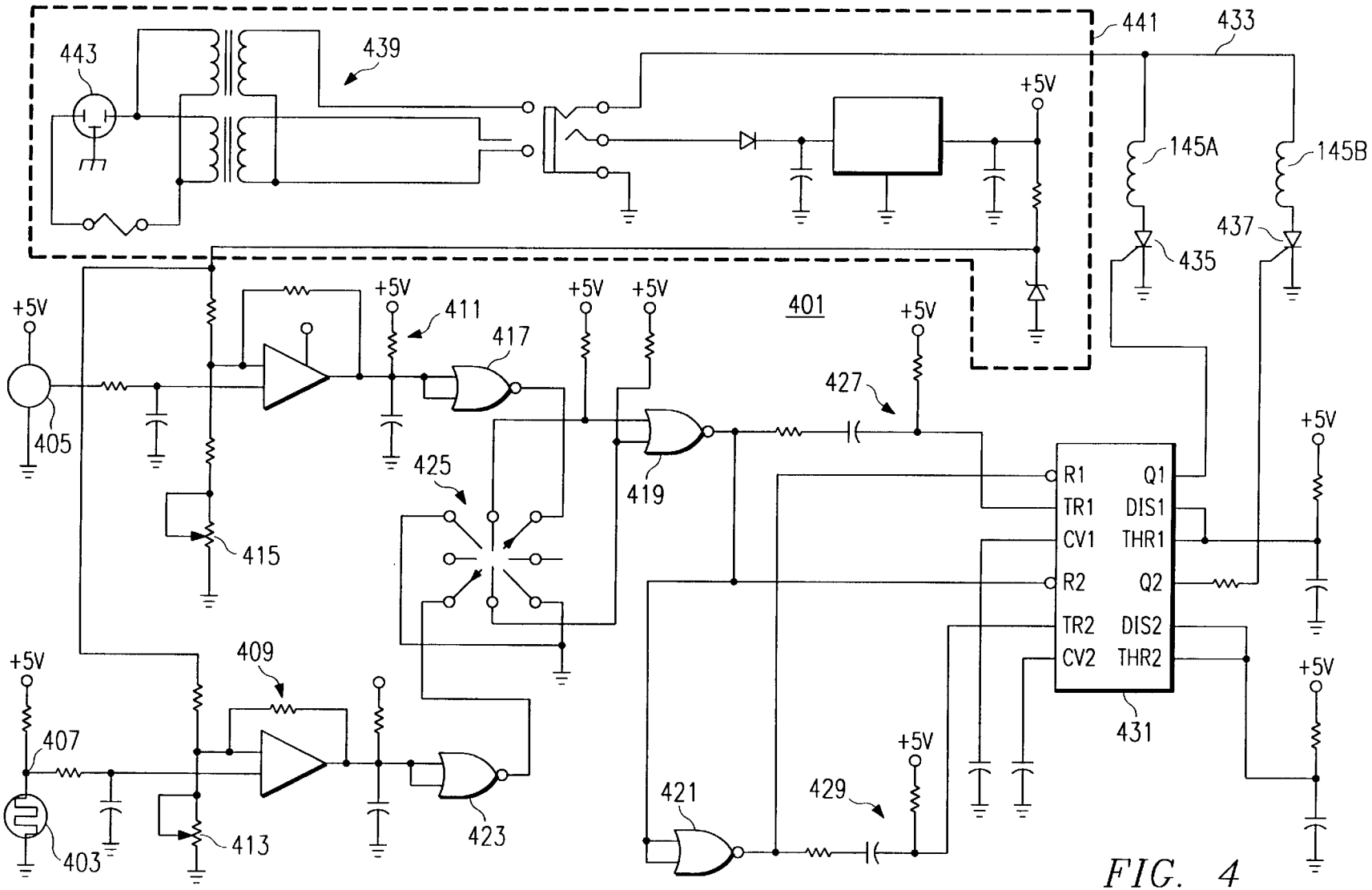
FIG. 4 is a schematic diagram of a remote electronic controller that is shown coupled to two sma springs used in the blind positioning mechanism shown in FIG. 1, the controller automatically causing opening and closing of the blinds in response to ambient light and temperature conditions.

Referring now to FIG. 4, controller 401 generates the currents to heat the sma springs 145A and 145B (FIG. 2) in response to comparisons between sensed ambient light and temperature conditions and user selected light and temperature thresholds. The controller may be either remotely installed, and used, with minor modifications to control a plurality of blinds and may be integrated into the blind mechanism itself, if desired. Light conditions are sensed with light sensor 403, such as a cadmium sulfide photoresistor, and temperature sensor 405, such a National Semiconductor LM35DZ. A resistively scaled voltage of the photoresistor at input 407 that is inversely related to the light level is provided to the inverting input of analog voltage comparator circuit 409. Similarly, the voltage generated by the temperature sensor 405, which is proportionally related to the temperature level, is provided to analog voltage comparator circuit 411.

The output voltages of the sensors are compared to voltages set by a user with potentiometer 413 (for the light) and 415 (for the temperature) to correspond to desired light and temperature conditions. The input and output relationship of each voltage comparator circuit 409 and 411 is hysteresis-like. This prevents spurious oscillations in the output voltage of the comparator circuits when the temperature and light conditions are near the threshold values.

The outputs of the voltage comparator circuits 409 and 411 are coupled to logic circuitry that includes four NOR gates 417, 419, 421, 423 and double-pole switch 425. The function of switch 425 is to turn the light and temperature sensors "on" and "off" by connecting and disconnecting the outputs of the voltage comparator circuits 409 and 411 to the logic circuitry. The logic circuitry determines, in response to the outputs of the voltage comparator circuits, whether the blinds should be opened or closed, according to the following criteria.

When the ambient light level is or falls below the light level set by the user, the blinds are closed, regardless of the temperature. This keeps the blinds closed at night for purposes of privacy. When the ambient temperature is or rises above the preset temperature, the blinds are also closed to help the environment remain cool or cool down efficiently. Otherwise, when the ambient light is brighter than the light threshold and the temperature less than the temperature threshold, the blinds are opened.

To implement this logic, the four NOR gates are used as follows. The logic NOR gates 417 and 423 simply act as inverters, inverting the output of the voltage comparator circuits 411 and 409, respectively. One input of NOR gate 419 is coupled to the inverted output of voltage comparator circuit 411 (for temperature) and the other input is coupled to the inverted output of voltage comparator circuit 409 (for light). The output of NOR gate 419 is connected to the two inputs of NOR gate 421, this NOR gate thus acting as an inverter, as well as to differentiator circuit 427 and a second time reset input R2 of dual timer integrated circuit (LM556) 431. The output of NOR gate 421 is connected to differentiator circuit 429 and to the first timer reset input R1 of timer circuit 431. The outputs of the differentiator circuits 427 and 429 are connected to the trigger inputs, TR1 and TR2, respectively, for the first and second timers on integrated timer circuit 431.

Upon transition of the light level to above its preset threshold when the temperature is already below its preset threshold, or upon the transition of the temperature to below the threshold when the light level is already above its threshold, the output of NOR gate 419 transitions from a high to a low, causing the differentiator circuit 427 to trigger the first timer and NOR gate 421 to reset the second timer.

Upon transition of the output of NOR gate 419 from low to high, as caused by the temperature rising above its threshold or the light falling below its threshold, the output of NOR gate 419 resets the second timer before the output of differentiator circuit 429 triggers the second timer.

The output of each timer, Q1 for the first timer and Q2 for the second timer, is connected to the control inputs of silicon rectifiers 435 and 437, respectively. Triacs may be substituted for the silicon controlled rectifiers. A current supply line taken off a second tap of a step down transformer's 439 secondary winding in AC power supply 441, which is at 4 volts AC, is electrically coupled, in the manner shown in FIG. 1, to one end of each of the memory alloy springs 145A and 145B (FIG. 1) mounted in the blind positioning mechanism 101 (FIG. 1). The other end of springs 145A and 145B is coupled separately to the silicon controlled rectifiers 435 and 437. The silicon controlled rectifiers act as switches, closing the circuit to permit current to flow through the memory alloy springs to heat them. The current has an AC average of approximately 2 amperes. The shape memory alloy wire comprising the sma springs has a nominal resistance of 1 ohm. As the heating of the sma spring is equal to the product of the current squared and the resistance, dissipating four watts or 20 joules which is sufficient to heat each sma spring past the martensite finish temperature, requires current to flow for approximately forty seconds. Therefore, the timers of timing circuit 431 are set for forty seconds, which provides sufficient heating of the sma springs to change states and fully extend.

AC power supply 441 includes a step down transformer 439 connected to an AC power signal source 443. One tap of the transformer is connected to voltage regulator integrated circuit 445 to provide five volts of power to the logic and comparator circuits.

Other embodiments include using in place of timing circuit 431 and the logic circuitry a programmable microprocessor or microcontroller. The microprocessor receives inputs from the environmental sensors, either from the voltage comparator circuits or from an analog to digital converter, and sends control signals to the silicon controlled rectifiers to open and close the current. A digital computer may be used to control the blinds of an entire building, if desired, and to work in conjunction with heating, ventilation and air conditioning systems and security systems to optimize energy use and security. If a DC power supply is used in place of AC power supply 441, the silicon controlled rectifiers would be replaced with transistors.

It will be appreciated that there is a difference between the transformation or transition temperature of the alloy used in the sma springs and the actuation temperature of the controller or control electronics which can be set by the user. For example, the transition temperature of one shape memory alloy is at 60° C. to 63° C. with 15° C. hysteresis. The transition temperature refers to the actual temperature of the alloy when it undergoes its martensitic transformation. The temperature associated with the controller or control electronics refers to the temperature of the environment or of the air surrounding the temperature sensor of the controller. The temperature of the environment controls or drives the controller or control electronics while the controller provides the current to drive the temperature of the sma spring above the transition temperature of, for example, 60° C. to 63° C.

Figure 5:
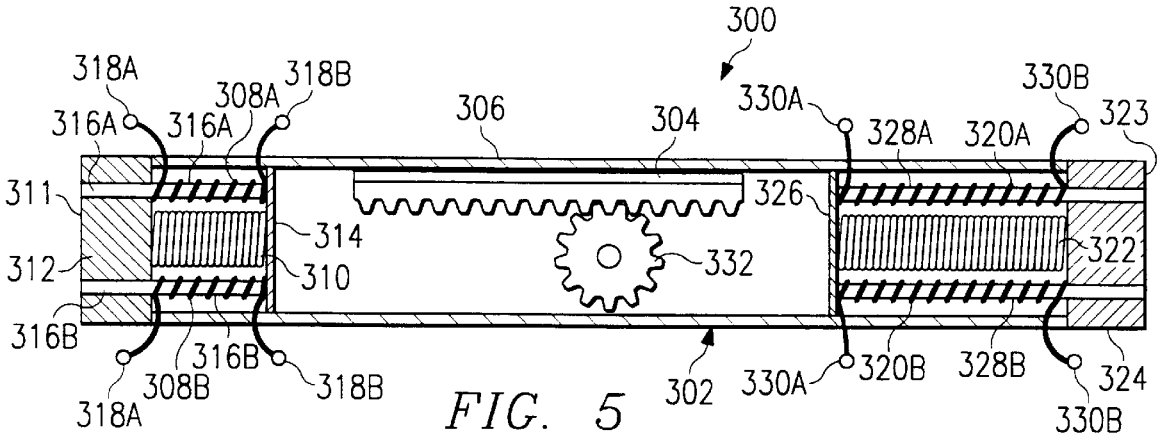
FIG. 5 is a bottom plan view of another embodiment of the actuator module in accordance with the present invention.

Referring to FIG. 5, an alternative embodiment of an actuator module according to the present invention is referred to generally by reference numeral 300 and is configured primarily for horizontal blinds rather than vertical blinds. Actuator module 300 comprises housing 302, a first sma spring device, a second sma spring device, a rack and a pinion gear.

First sma spring device comprises sma springs 308A and 308B, movable guide rods 316A and 316B, and first bar 314. Rack 304 is mounted for sliding movement along wall 306 of housing 302. Sma springs 308A and 308B are positioned on opposite sides of first extension spring 310 at a first end 311 of housing 302 and are located between a first non-conductive support block 312 and first bar 314. First bar 314 is attached to movable guide rods 316A and 316B around which are positioned sma springs 308A and 308B, respectively. An output of a controller (such as disclosed in FIG. 4) is connected to the ends of the memory alloy springs 308A and 308B at terminals 318A and 318B to provide the desired amount of current through the sma springs.

Second sma spring device comprises sma springs 320A and 320B, movable guide rods 328A and 328B, and second bar 326. Sma springs 320A and 320B are positioned on opposite sides of second extension spring 322 at a second end 323 of housing 302 and are located between a second non-conductive support block 324 and second bar 326. Second bar 326 is attached to movable guide rods 328A and 328B around which are positioned sma springs 320A and 320B, respectively. Sma springs 320A and 320B are two times the length of sma springs 308A and 308B. Another output of the controller of FIG. 4 is connected to the ends of the sma springs 320A and 320B at terminals 330A and 330B to provide the desired amount of current through the sma springs.

To obtain more or additional force in any of the disclosed embodiment, the sma springs are physically placed in parallel and may be electrically wired in either series or parallel and if more stroke is desired, the sma springs may be physically placed in series or simply made longer as a unit and again may be wired in series or parallel.

Pinion gear 332 is rotatably mounted with respect to wall 306 and engages rack 304. A bevel gear (not shown) is positioned on the other side of wall 306 and is attached to and rotates with pinion gear 332 similar to pinion gear 133 and bevel gear 131 in FIG. 1.

With actuator module 300 mounted in the middle of the enclosure of a horizontal blind, the bevel gear (not shown) of the actuator module 300 would engage a bevel gear which is mounted on the horizontal shaft of the horizontal blind.

In operation, when sma springs 308A and 308B are activated by a controller or current source, they will extend in length and cause first bar 314 to move to the right and move rack 304 a predetermined distance. For example, rack 304 may be moved to the position shown, which would rotate the horizontal slats of the horizontal blind to the open position to allow light past the horizontal blind. When power is no longer applied to sma springs 308A and 308B, first extension spring 310 will cause first bar 314 and sma springs 308A and 308B to return to the position shown in FIG. 5. Rack 304 will remain in the position shown in FIG. 5 which allows an individual to rotate the slats to a desired position without interference from actuator module 300.

When the environmental conditions indicate that the slats of the blind should be closed, sma springs 320A and 320B are activated by the controller and move second bar 326 to the left and move rack 304 to the left to the position which rotates (through pinion gear 332 and the bevel gears) the slats to the closed position. When power is no longer applied to sma springs 320A and 320B, second extension spring 322 will cause second bar 326 and sma springs 320A and 320B to return to the position shown in FIG. 5.

It will be appreciated that the two sets of sma springs 308A, 308B and 320A, 320B may be structured to be the same length and then control the length of their extension by controlling the amount of current flowing through them and thereby control the position of the horizontal slats to any degree or position between fully open and fully closed. Also, a variable slide resistor could be attached to rack 304 and the resistance could be provided to a controller so the controller would know the position of the horizontal slats by knowing the position of the rack and could then provide the right amount of current to the particular set of sma springs to move the rack and the horizontal slats to any desired position.

Figure 6:
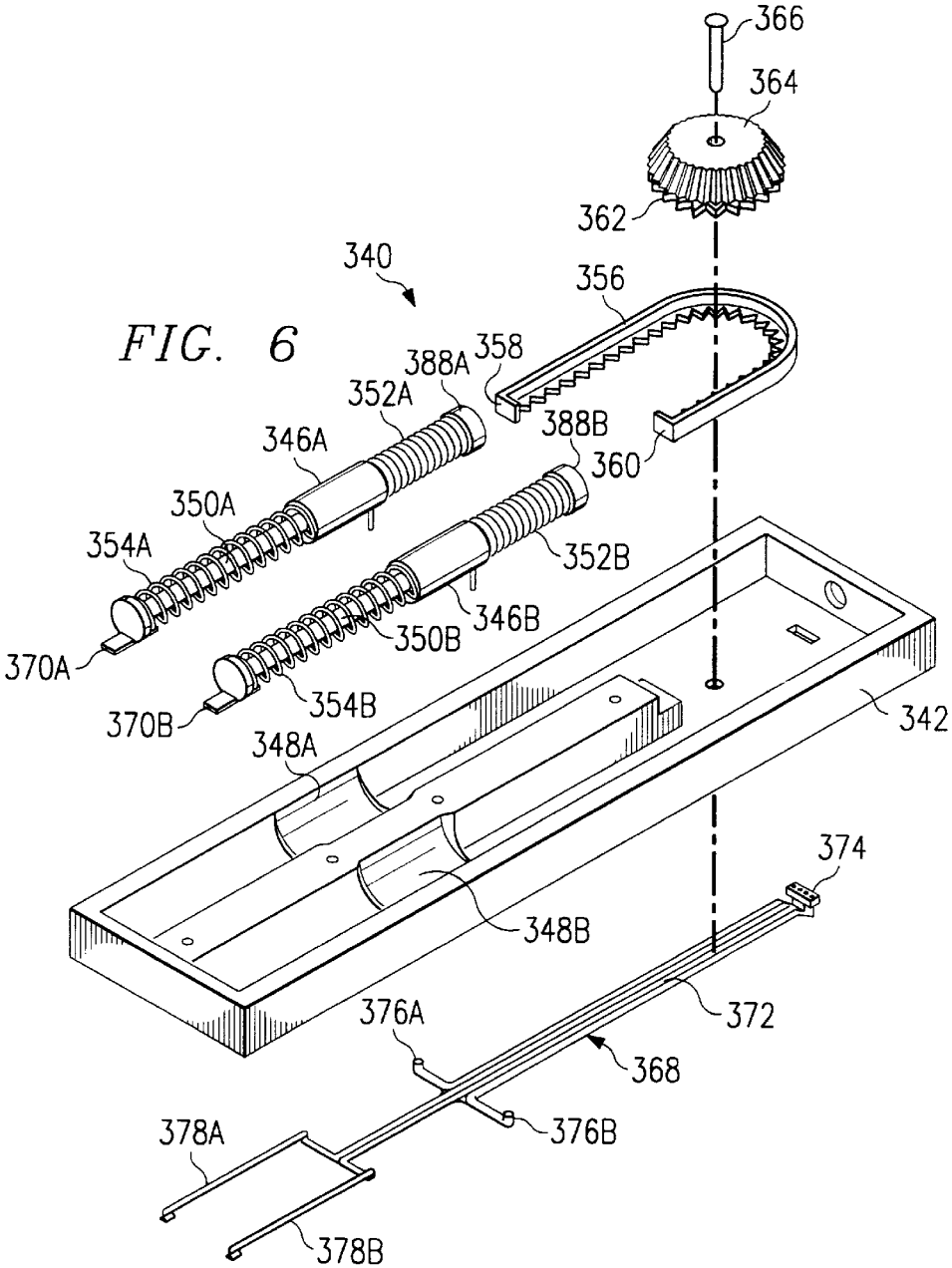
FIG. 6 is an exploded perspective view of another embodiment of the actuator module in accordance with the present invention.

Referring to FIG. 6, another alternative embodiment of an actuator module according to the present invention is referred to generally by reference numeral 340. Actuator module 340 comprises housing 342, a first sma spring device, a second sma spring device, a rack and a pinion gear.

First sma spring device comprises sma spring 352A, parallel rod 350A and insulative support block 346A. Insulative support block 346A is positioned in cutout 348A. Insulative support block 346A supports parallel rod 350A which in turn supports sma spring 352A on a first end thereof and compression spring 354A on a second and opposite end thereof.

Second sma spring device comprises sma spring 352B, parallel rod 350B and insulative support block 346B. Insulative support block 346B is positioned in cutout 348B. Insulative support block 346B supports parallel rod 350B which in turn supports sma spring 352B on a first end thereof and compression spring 354B on a second and opposite end thereof.

Articulating rack or actuation gear strip 356 is mounted in housing 342 for sliding movement therein with end 358 positioned to be contacted by rod 350A and end 360 positioned to be contacted by rod 350B. Pinion gear 362 together with bevel gear 364 are mounted for rotational movement by pin 366 with pinion gear 362 engaging articulating rack 356. Bevel gear 364 is positioned to engage the bevel gear (not shown) of the blind.

Electrical current is supplied to memory alloy springs 352A and 352B from a controller, such as that disclosed in FIG. 4, by cable means 368, electrical pick-up shoes 370A and 370B and rods 350A and 350B. Cable means 368 comprises wires 372 connected from jack 374 to connectors 376A and 376B and to electrical conductive rails 378A and 378B. Cable means 368 is positioned against the bottom of housing 342 with connectors 376A and 376B and conductive rails 378A and 378B protruding upwardly through openings in the bottom of housing 342.

Figure 7:
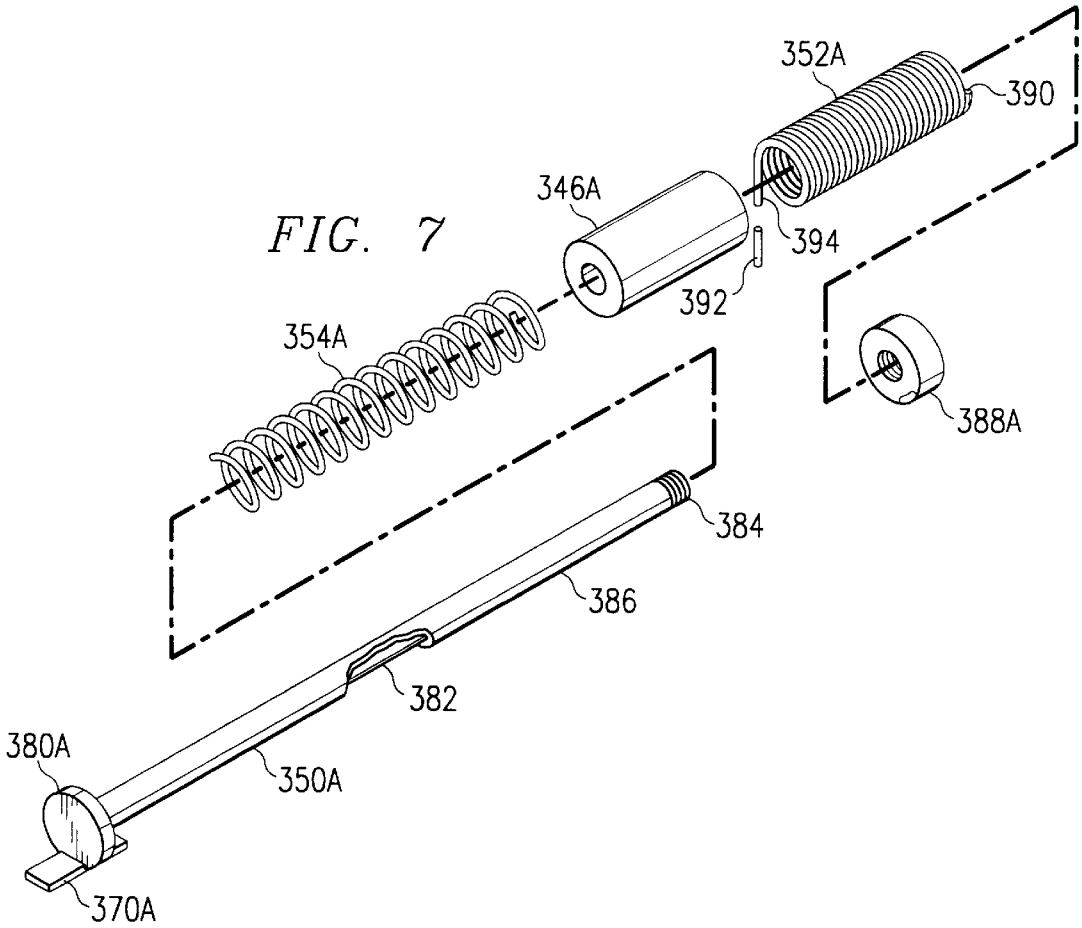
FIG. 7 is an exploded perspective view of a portion of the sma spring actuator of the embodiment shown in FIG. 6.

The connections to the memory alloy springs is best shown with reference to FIG. 7 which discloses the details of the first sma spring device of FIG. 6. Rod 350A comprises an electrical conductive head 380A with a conductive core 382 connected between a conductive threaded end 384 and head 380A with the conductive core being surrounded with an insulative covering 386. Electrical pick-up shoe 370A is removably attached to head 380A. After rod 350A is inserted through compression spring 354A, support block 346A and memory alloy spring 352A, conductive nut 388A is attached to threaded end 384 in a manner to made electrical contact with end 390 of sma spring 352A. This first sma spring device is positioned in housing 342 and connector 392 is connected between end 394 of sma spring 352A and connector 376A of cable means 368.

For explanatory purposes, the actuator module 340 will be installed in the blind such that sma spring 352B will be activated to open the slats of the blind and sma spring 352A will be activated to close the slats of the blind. In operation, sma spring 352B will be activated through cable means 368 and cause conductive nut 388B to push against end 360 of articulating rack 356 and move rack 356 to the position shown in FIG. 6. Pinion gear 362 together with bevel gear 364 will be rotated by the movement of articulating rack 356 resulting in the opening of the slats of the blind. When power is no longer applied to sma spring 352B, compression spring 354B will cause rod 350B and sma spring 352B to return to the position shown in FIG. 6. Articulating rack 356 will remain in the position shown in FIG. 6 which allows an individual to rotate the slats to a desired position without interference from actuator module 340.

When the environmental conditions indicate that the slats of the blind should be closed, sma spring 352A is activated by the controller through cable means 368 and conductive nut 388A will push against end 358 and move articulating rack 356 to the position which rotates (through pinion gear 362 and the bevel gears) the slats of the blind to the closed position. When power is no longer applied to sma spring 352A, compression spring 354A will cause rod 350A and sma spring 352A to return to the position shown in FIG. 6. Articulating rack 356 will remain in the position shown in FIG. 6 which allows an individual to rotate the slats to a desired position without interference from actuator module 340.

Figure 8:
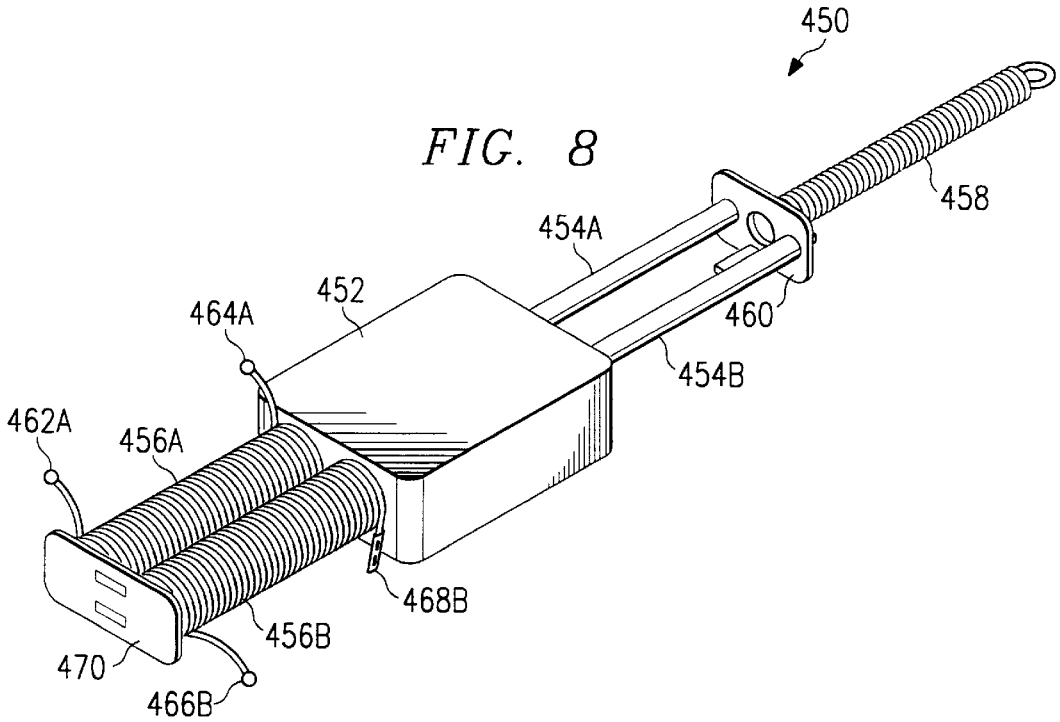
FIG. 8 is a front perspective view of another actuator assembly in accordance with the present invention.

Referring to FIG. 8, another alternative embodiment of an actuator assembly (of an actuator module) according to the present invention is referred to generally by reference numeral 450. Actuator assembly 450 would be mounted in a housing and comprises a support block 452 mounted to the housing, two support rods 454A and 454B supported in support block 452 and sma springs 456A and 456B are positioned around support rods 454A and 454B, respectively. Extension spring 458 is connected between the housing and bar 460 which is attached to a first end of support rods 454A and 454B. Current to activate sma springs 456A and 456B are supplied to terminals 462A, 464A, 466B and 468B from suitable activating means.

In operation, when sma springs 456A and 456B are activated and expand in length, bar 470 (which is attached to a second end of support rods 454A and 454B) will be moved to the left and extension spring 458 will be stretched or extended. When power is no longer applied to sma springs 456A and 456B, extension spring 458 will move bar 470 back to the position shown in FIG. 8. By providing two sma springs working together, the amount of force provided by them is doubled.

It will be appreciated that controlling the position of the rack or the amount of stroke of the rack associated with the various actuators of the present invention may be accomplished by three different means or methods as follows: 1) a variable resistor may be attached to the rack whose output resistance will vary from X ohms to Y ohms that will correspond to the position of the pinion gear (and all elements downstream of the pinion gear) that interfaces with the rack. There will be an algorithm in software that will cut off the current to the shape memory alloy spring to stop the rack at the desired resistance value (which corresponds to the desired location of the rack) that is returned through the feedback loop; 2) controlling the amount of current through the shape memory alloy spring with the amount of current being based upon the heat transfer rate of the design of the actuator. The algorithm being based upon knowing the amount of current and the amount of time of applying the current for driving the blind to a desired position; and 3) A light sensor would be used to replace the photoelectric cell in the controller and the value of the resistor would be chosen to determine the threshold point for which the actuator will either close or open the blind based upon the amount of light hitting the light sensor. A length of fiber optics could be used as a light conduit to the light sensor.

The invention has been described in its preferred embodiments for purposes of illustrating and explaining the invention. This detailed description should not be construed as limiting the invention to the embodiment set forth. Modifications may be made to the preferred embodiments without departing from the spirit and scope of the invention as defined and set forth by the appended claims.

I claim:

1. A temperature responsive actuator module comprising:

a housing;

a first shape memory alloy spring device mounted within said housing and including at least one shape memory alloy spring, the at least one shape memory alloy spring changing phase when above a predetermined temperature and extending linearly a first predetermined distance in a first predetermined direction;

a second shape memory alloy spring device mounted within said housing and including at least one shape memory alloy spring, the at least one shape memory alloy spring changing phase when above a predetermined temperature and extending linearly a second predetermined distance in a second predetermined direction;

a mechanical interface device mounted within said housing and positioned with respect to said first shape memory alloy spring device and said second shape memory alloy spring device such that said mechanical interface device will be moved in a first direction when contacted by said first shape memory alloy spring device and will be moved in a second and opposite direction when contacted by said second shape memory alloy spring device.

2. The actuator module of claim 1 wherein the mechanical interface device comprises a rack mechanism.

3. The actuator module of claim 1 wherein the mechanical interface device comprises a rack and pinion mechanism.

4. The actuator module of claim 1 wherein the first shape memory alloy spring device comprises two shape memory alloy springs positioned in parallel.

5. The actuator module of claim 1 wherein the second shape memory alloy spring device comprises two shape memory alloy springs positioned in parallel.

6. The actuator module of claim 1 wherein the mechanical interface device comprises an articulating rack.

7. The actuator module of claim 1 wherein the mechanical interface device comprises an articulating rack and pinion mechanism.

8. The actuator module of claim 1 further including a first biasing spring for laterally displacing the first shape memory alloy spring device in a direction opposite the first predetermined direction to remove the first shape memory alloy spring device from contact with the mechanical interface device when the at least one shape memory alloy spring of the first shape memory alloy spring device is not extended.

9. The actuator module of claim 8 further including a second biasing spring for laterally displacing the second shape memory alloy spring device in a direction opposite the second predetermined direction to remove the second shape memory alloy spring device from contact with the mechanical interface device when the at least one shape memory alloy spring of the second shape memory alloy spring device is not extended.

10. The actuator module of claim 1 further comprising a current source for supplying a current through the at least one shape memory alloy spring of the first shape memory alloy spring device to cause the at least one shape memory alloy spring to heat and extend.

11. The actuator module of claim 1 further comprising a current source for supplying a current through the at least one shape memory alloy spring of the second shape memory alloy spring device to cause the at least one shape memory alloy spring to heat and extend.

12. The actuator module of claim 10 further including a sensor responsive to an environmental condition, the sensor coupled to the current source for causing, in response to a predetermined environmental condition, the current source to conduct current through the at least one shape memory alloy spring of the first shape memory alloy spring device for heating the at least one shape memory alloy spring.

13. The actuator module of claim 11 further including a sensor responsive to an environmental condition, the sensor coupled to the current source for causing, in response to a predetermined environmental condition, the current source to conduct current through the at least one shape memory alloy spring of the second shape memory alloy spring device for heating the at least one shape memory alloy spring.

14. The actuator module of claim 1 further comprising a controller coupled to an environmental sensor, the controller having a first current output coupled to the at least one shape memory alloy spring of the first shape memory alloy spring device and a second current output coupled to the at least one shape memory alloy spring of the second shape memory alloy spring device, the controller causing current to flow through the at least one shape memory alloy spring of the first shape memory alloy spring device to heat the at least one shape memory alloy spring in response to a first environmental condition sensed by the environmental sensor and causing current to flow through the at least one shape memory alloy spring of the second shape memory alloy spring device to heat the at least one shape memory alloy spring in response to a second environmental condition sensed by the environmental sensor.

15. A temperature responsive actuator module comprising:

a housing;

a shape memory alloy spring device mounted within said housing and including at least one shape memory alloy spring, the at least one shape memory alloy spring changing phase from a first position when above a predetermined temperature and extending linearly a predetermined distance in a predetermined direction to a second position; and a mechanical interface device mounted within said housing and positioned with respect to said shape memory alloy spring device such that said mechanical interface device will be moved in a first direction when contacted by said shape memory alloy spring device, wherein the shape memory alloy spring uncouples from the mechanical interface device when returning from the second position to the first position whereby the mechanical interface device will remain where it was moved in the first direction unless acted upon by some force other than the at least one shape memory alloy spring.

16. The actuator module of claim 15 wherein the mechanical interface comprises a rack mechanism.

17. The actuator module of claim 15 wherein the mechanical interface comprises a rack and pinion mechanism.

18. The actuator module of claim 15 wherein the shape memory alloy spring device includes at least one rod.

19. The actuator module of claim 18 wherein the at least one rod includes a bar attached to a predetermined end of said at least one rod.

20. The actuator module of claim 18 wherein the said at least one shape memory alloy spring is positioned around said rod.

21. The actuator module of claim 15 wherein the shape memory alloy spring device comprises two shape memory alloy springs positioned in parallel.

22. The actuator module of claim 15 further including a biasing spring for laterally displacing the shape memory alloy spring device in a direction opposite the predetermined direction to remove the at least one shape memory alloy spring device from contact with the mechanical interface device when the at least one shape memory alloy spring is not extended to the second position unless the mechanical interface device is acted upon by some force other than the at least one shape memory alloy spring.

23. The actuator module of claim 22 wherein said biasing spring comprises an extension spring.

24. The actuator module of claim 22 wherein said biasing spring comprises a compression spring.

25. The actuator module of claim 15 further comprising a current a source for supplying current through the at least one shape memory alloy spring of the shape memory alloy spring device to cause the at least on shape memory spring to heat and extend.

26. The actuator module of claim 25 further comprising a sensor responsive to a predetermined condition, the sensor coupled to the current source for causing, in response to the predetermined condition, the current source to conduct current through the at least one shape memory alloy spring of the shape memory alloy spring device for heating the at least one shape memory alloy spring.

27. An actuator module comprising:

a housing;

a shape memory alloy spring device mounted within said housing and including at least one shape memory alloy spring, the at least one shape memory alloy spring changing phase from a first position when above a predetermined temperature and extending linearly a predetermined distance in a predetermined direction to a second position;

a current a source for supplying current through the at least one shape memory alloy spring of the shape memory alloy spring device to cause the at least on shape memory spring to heat and extend; and a mechanical interface device mounted within said housing and positioned with respect to said shape memory alloy spring device such that said mechanical interface device will be moved in a first direction when contacted by said shape memory alloy spring device, wherein the shape memory alloy spring uncouples from the mechanical interface device when returning from the second position to the first position whereby the mechanical interface device will remain where it was moved in the first direction unless acted upon by some other force.

28. The actuator module of claim 27 wherein the mechanical interface comprises a rack mechanism.

29. The actuator module of claim 27 wherein the mechanical interface comprises a rack and pinion mechanism.

30. The actuator module of claim 27 wherein the shape memory alloy spring device includes at least one rod.

31. The actuator module of claim 30 wherein the at least one rod includes a bar attached to a predetermined end of said at least one rod.

32. The actuator module of claim 30 wherein the said at least one shape memory alloy spring is positioned around said rod.

33. The actuator module of claim 27 wherein the shape memory alloy spring device comprises two shape memory alloy springs positioned in parallel.

34. The actuator module of claim 27 further including a biasing spring for laterally displacing the shape memory alloy spring device in a direction opposite the predetermined direction to remove the shape memory alloy spring device from contact with the mechanical interface device when the at least one shape memory alloy spring of the shape memory alloy spring device is not extended.

35. The actuator module of claim 34 wherein said biasing spring comprises an extension spring.

36. The actuator module of claim 34 wherein said biasing spring comprises a compression spring.

37. The actuator module of claim 35 further comprising a sensor responsive to a predetermined condition, the sensor coupled to the current source for causing, in response to the predetermined condition, the current source to conduct current through the at least one shape memory alloy spring of the shape memory alloy spring device for heating the at least one shape memory alloy spring.

38. An actuator module comprising:

a housing;

a first shape memory alloy spring device mounted within said housing and including at least one shape memory alloy spring, the at least one shape memory alloy spring changing phase when above a predetermined temperature and extending linearly a first predetermined distance in a first predetermined direction;

a second shape memory alloy spring device mounted within said housing and including at least one shape memory alloy spring, the at least one shape memory alloy spring changing phase when above a predetermined temperature and extending linearly a second predetermined distance in a second predetermined direction;

a first current source for supplying a current through the at least one shape memory alloy spring of the first shape memory alloy spring device to cause the at least one shape memory alloy spring to heat and extend;

a second current source for supplying a current through the at least one shape memory alloy spring of the second shape memory alloy spring device to cause the at least one shape memory alloy spring to heat and extend; and a mechanical interface device mounted within said housing and positioned with respect to said first shape memory alloy spring device and said second shape memory alloy spring device such that said mechanical interface device will be moved in a first direction when contacted by said first shape memory alloy spring device and will be moved in a second and opposite direction when contacted by said second shape memory alloy spring device.

39. The actuator module of claim 38 wherein the mechanical interface device comprises a rack mechanism.

40. The actuator module of claim 38 wherein the mechanical interface device comprises a rack and pinion mechanism.

41. The actuator module of claim 38 wherein the first shape memory alloy spring device comprises two shape memory alloy springs positioned in parallel.

42. The actuator module of claim 38 wherein the second shape memory alloy spring device comprises two shape memory alloy springs positioned in parallel.

43. The actuator module of claim 38 wherein the mechanical interface device comprises an articulating rack.

44. The actuator module of claim 38 wherein the mechanical interface device comprises an articulating rack and pinion mechanism.

45. The actuator module of claim 38 further including a first biasing spring for laterally displacing the first shape memory alloy spring device in a direction opposite the first predetermined direction to remove the first shape memory alloy spring device from contact with the mechanical interface device when the at least one shape memory alloy spring of the first shape memory alloy spring device is not extended.

46. The actuator module of claim 45 further including a second biasing spring for laterally displacing the second shape memory alloy spring device in a direction opposite the second predetermined direction to remove the second shape memory alloy spring device from contact with the mechanical interface device when the at least one shape memory alloy spring of the second shape memory alloy spring device is not extended.

47. The actuator module of claim 38 further including a sensor responsive to an environmental condition, the sensor coupled to the first current source for causing, in response to a predetermined environmental condition, the current source to conduct current through the at least one shape memory alloy spring of the first shape memory alloy spring device for heating the at least one shape memory alloy spring.

48. The actuator module of claim 38 further including a sensor responsive to an environmental condition, the sensor coupled to the second current source for causing, in response to a predetermined environmental condition, the current source to conduct current through the at least one shape memory alloy spring of the second shape memory alloy spring device for heating the at least one shape memory alloy spring.

49. The actuator module of claim 38 further comprising a controller coupled to an environmental sensor, the controller having a first current output coupled to the at least one shape memory alloy spring of the first shape memory alloy spring device and a second current output coupled to the at least one shape memory alloy spring of the second shape memory alloy spring device, the controller causing current to flow through the at least one shape memory alloy spring of the first shape memory alloy spring device to heat the at least one shape memory alloy spring in response to a first environmental condition sensed by the environmental sensor and causing current to flow through the at least one shape memory alloy spring of the second shape memory alloy spring device to heat the at least one shape memory alloy spring in response to a second environmental condition sensed by the environmental sensor.

* * * * *

UNITED STATES PATENT AND TRADEMARK OFFICE

CERTIFICATE OF CORRECTION

PATENT NO. : 5,816,306
DATED : October 6, 1998
INVENTOR(S) : Giacomel, Jeffrey A.

It is certified that error appears in the above-identified patent and that said Letters Patent is hereby corrected as shown below:

On the title page: [*] Notice : please delete "5,275,217" and substiute therefor –5,275,219--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*